US010357076B2

(12) United States Patent
Lipkens

(10) Patent No.: US 10,357,076 B2
(45) Date of Patent: Jul. 23, 2019

(54) VISOR ASSEMBLY

(71) Applicant: PWL & RS PATENTS BVBA, Bocholt (BE)

(72) Inventor: Paul Wilhelmus Lipkens, Meeuwen-Gruitrode (BE)

(73) Assignee: PWL & RS PATENTS BVBA, Bocholt (BE)

( * ) Notice: Subject to any disclaimer, the term of this patent is extended or adjusted under 35 U.S.C. 154(b) by 103 days.

(21) Appl. No.: 15/300,413

(22) PCT Filed: Apr. 2, 2015

(86) PCT No.: PCT/BE2015/000011

§ 371 (c)(1),
(2) Date: Sep. 29, 2016

(87) PCT Pub. No.: WO2015/149137

PCT Pub. Date: Oct. 8, 2015

(65) Prior Publication Data

US 2017/0150768 A1 Jun. 1, 2017

(30) Foreign Application Priority Data

Apr. 4, 2014 (BE) ..... 2014/0230

(51) Int. Cl.
*A42B 3/22* (2006.01)
*A42B 3/24* (2006.01)

(52) U.S. Cl.
CPC ..... *A42B 3/222* (2013.01); *A42B 3/226* (2013.01); *A42B 3/24* (2013.01)

(58) Field of Classification Search
CPC ..... A42B 3/222; A42B 3/24
See application file for complete search history.

(56) References Cited

U.S. PATENT DOCUMENTS

| | | | | |
|---|---|---|---|---|
| 6,405,373 | B1 | 6/2002 | Grau | |
| 6,922,850 | B1 * | 8/2005 | Arnold | A42B 3/226 2/424 |
| 9,801,425 | B2 * | 10/2017 | Ahn | A42B 3/24 |
| 2006/0010572 | A1 * | 1/2006 | Douglas | A42B 3/24 2/231 |

(Continued)

FOREIGN PATENT DOCUMENTS

| | | |
|---|---|---|
| EP | 0802743 B1 | 4/1999 |
| JP | 63-219609 | 9/1988 |

OTHER PUBLICATIONS

International Search Report and Written Opinion dated Aug. 11, 2015 for PCT Application No. PCT/BE2015/000011 Filed Apr. 2, 2015.

*Primary Examiner* — Clinton T Ostrup
*Assistant Examiner* — Andrew Wayne Sutton

(57) ABSTRACT

Visor assembly (1) comprising an outer shield (2) and an inner shield (6) which is arranged at a distance therefrom and lies within the periphery of the outer shield, wherein a spacer (7) extending along the periphery of the inner shield is provided in order to hold the inner shield at a predetermined distance from the outer shield, wherein mechanical fixing means (10, 12) are arranged between the two shields for mutual fixation thereof, wherein the inner shield is formed at the position of its periphery such that a protrusion (7) from the inner shield is obtained, this protrusion forming the spacer.

12 Claims, 2 Drawing Sheets

(56) References Cited

U.S. PATENT DOCUMENTS

| | | | | |
|---|---|---|---|---|
| 2009/0293165 | A1 | 12/2009 | Arnold | |
| 2010/0175160 | A1 | 7/2010 | Arnold | |
| 2017/0006953 | A1* | 1/2017 | Kataoka | A42B 3/226 |
| 2017/0150768 | A1* | 6/2017 | Lipkens | A42B 3/222 |

* cited by examiner

VISOR ASSEMBLY

The invention relates to a visor assembly comprising an outer shield and an inner shield which is arranged at a distance therefrom and lies within the periphery of the outer shield, wherein a spacer extending along the periphery of the inner shield is provided in order to hold the inner shield at a predetermined distance from the outer shield, wherein mechanical fixing means are arranged between the two shields for mutual fixation thereof.

Such an assembly is known from NL1012896. The spacer is formed here from a silicone material which is adhered to the inner shield but not to the outer shield. The inner shield can hereby be positioned in replaceable manner relative to the outer shield. The distance between inner shield and outer shield is found in practice to be an advantage because it creates an insulation layer between inside and outside. Because the spacer is only connected to the inner shield, the inner shield will further be able to distort (for instance as a result of temperature differences) relative to the outer shield.

A drawback of such a construction is that the manufacture of the inner shields in particular is complex and time-consuming. The silicone layer will thus have to be arranged with a constant thickness along the periphery of the inner shield, after which the silicone layer must cure without coming into contact here with contaminants or external elements. For this purpose inner shields have to be positioned dust and dirt-free for a long period of time without the silicone layer coming into contact with an external element. Dust and dirt can adversely affect the silicone layer, whereby inner shield and outer shield cannot be mounted correctly relative to each other.

It is an object of the invention to provide a visor assembly with improved inner shield.

The invention has for this purpose the feature that the inner shield comprises a protrusion at the position of its periphery, this protrusion forming the spacer.

As will be apparent from the foregoing, the spacer is formed by the inner shield. Attachment of the inner shield to the outer shield takes place using mechanical means. It is thereby possible to break the connection between the inner shield and the outer shield at any desired moment. This may for instance be the case when the outer shield is damaged. This may moreover be necessary when the inner side of the outer shield or the outer side of the inner shield becomes damp or soiled for any reason. Because the spacer is formed by the protrusion from the inner shield, a silicone layer will no longer be necessary. The manufacture of inner shields hereby becomes considerably simpler. This is because no adhesion and/or drying need take place after deforming of the inner shield. The inner shield is immediately available for further use after being formed. Tests have shown that, due to this construction, the inner shield can distort relative to the outer shield such that temperature differences will not result in any appreciable internal stresses. The invention further has an unexpected advantage when the inner shield has reached the end of its lifespan. This is because recycling of the inner shield will be considerably simpler since a spacer (of a material differing from the material of the inner shield) is not adhered thereto. Compared particularly to inner shields with a silicone layer (which is difficult to recycle), the inner shield of the invention will be easy to process at the end of its lifespan. According to the invention the inner shield can be manufactured from just one component because the spacer is formed by a protrusion from the inner shield such that recycling is easy.

The inner shield preferably has a substantially constant thickness. The constant thickness allows simple manufacture of the inner shield from a sheet material. The constant thickness of the inner shield will further have the result that the inner shield will have substantially the same reaction to external conditions, such as heat, over its whole surface area.

The protrusion preferably has a U-shaped cross-section. A sheet-like material can be easily provided with a U-shaped protrusion by being bent or indented. The U-shaped protrusion further allows the thickness of the inner shield to be kept constant. When a U-shaped protrusion is applied, the inner side of the inner shield (inside the protrusion) and the outer edge of the inner shield (outside the protrusion) will lie substantially in the same plane, this further simplifying the positioning of the inner shield in the outer shield. As alternative to the U-shaped cross-section, a protrusion can for instance also have a Z-shaped or other cross-section.

The protrusion is preferably arranged in the inner shield by mechanical deformation of the inner shield. Sheet material can be brought into a predetermined shape in simple manner via mechanical deformation. A sheet-like inner shield can be provided with a protrusion in simple manner via mechanical deformation.

The protrusion is preferably formed as a continuous channel running around a central zone of the inner shield, this continuous channel having a substantially constant depth. Because the channel is continuous and runs around a central zone of the shield, and because the channel has a substantially constant depth, it will be possible to press the inner shield against the outer shield in a manner such that the central zone is sealed airtightly from the surrounding area (because the protrusion runs all the way around the central zone and is continuous). An insulating effect is hereby obtained, which greatly improves the performance of the visor assembly in extreme conditions. The substantially constant depth is defined here as a depth which does not change, or does so only very gradually. Owing to a gradual change in the depth the protrusion will still be able to lie against the outer shield in continuous manner and with a constant force. When change is gradual, the depth will therefore also be considered as being substantially constant. On the basis of this definition it will be apparent that an embodiment wherein the protrusion has a depth of 3 mm at the position of a first segment of the periphery, this protrusion decreasing gradually over a second segment of the periphery to a depth of 1 mm and then gradually becoming deeper again via a third segment, is also deemed an embodiment with substantially constant depth.

The channel further preferably has a substantially constant width. Owing to the constant width forces acting on the inner shield as a result of the inner shield pressing against the outer shield can be absorbed uniformly.

The inner shield preferably comprises a material chosen from the group of the cellulose esters and cellulose ethers. The inner shield more preferably comprises a material chosen from cellulose acetate, cellulose propionate and cellulose acetate propionate, which material is heat-treated or has had an anti-fogging treatment. Cellulose derivatives are biodegradable, Recycling of the inner shield is hereby further simplified, particularly because the spacer is formed integrally with the inner shield (and so comprises no other material such as silicone).

The mechanical fixing means preferably comprise pins arranged on the outer shield and co-acting with recesses arranged on the inner shield. Such mechanical fixing means are known in the prior art for use of a visor assembly wherein the inner shield and outer shield are placed lying against each other. Such a construction is described in European patent application 95937212.9 from Derk's Patent B.V., which description is incorporated herein by reference.

In the present invention a distance is provided between the inner and outer shield. The above described pins and recesses co-acting therewith can be further developed depending on the application. The pins can thus comprise eccentric pins whereby precise adjustment to the position of the recesses can be obtained. The recesses moreover have to be arranged in attachments, which attachments are in turn arranged on the inner shield. When the attachments comprise a resilient construction, it is possible to compensate for any differences in tolerance between pins and recesses occurring either during production or during use.

According to an alternative embodiment of the invention, the outer shield is provided with a recess. The dimensions of these recesses correspond at least to the peripheral dimensions of the inner shield. The inner shield can be placed in such a recess. The mechanical fixing means can in that case comprise a snap edge or the like. Other constructions for fixing the inner shield in the receiving space can be easily envisaged by the skilled person and fall within the scope of the present invention.

The invention further relates to an inner shield provided so as to be placed within the periphery of an outer shield and at a distance therefrom, wherein a spacer extending along the periphery of the inner shield is provided in order to hold the inner shield at the predetermined distance, and wherein the inner shield is provided with mechanical fixing means for fixing the inner shield relative to the outer shield, characterized in that the inner shield is deformed at the position of its periphery such that a protrusion from the inner shield is obtained, this protrusion forming the spacer. This inner shield can be applied in a visor assembly as described above in order to realize the above described effects and advantages.

The invention further relates to a method for manufacturing an inner shield of a visor assembly according to the invention, wherein the method comprises of creating a protrusion along the periphery of an inner shield by means of deformation. As already described above, the creation of a protrusion by means of deformation is considerably simpler than placing a silicone edge on the shield. This is because, in contrast to a silicone edge, a protrusion created by deformation will not need to cure.

The method further preferably comprises of cutting the inner shield from a sheet-like material such that the inner shield fits within the periphery of a predetermined outer shield. The step of creating the protrusion and the step of cutting are preferably performed simultaneously here in a mould which comprises corresponding deforming surfaces and cutting edges for this purpose. Such a method allows the inner shield to be formed in a single production step. This is because the shield can be cut and formed (or deformed) in one movement of the mould.

The invention will now be further described on the basis of an exemplary embodiment shown in the drawing.

In the drawing.

The same or similar elements are designated in the drawing with the same reference numerals.

According to the invention a visor assembly is understood to mean any conceivable application. An important application is that in combination with helmets or other headgear. A further application is that of goggles-like constructions. Windows in vehicles and instrument covers and the like exposed to the open air can however also make use of the technique according to the invention. A particular application of the invention is formed by helmets, goggles and the like which are used at low temperature. There is for instance the problem in snowmobiles that moisture exhaled by the driver and/or passengers deposits as ice on the visor. Surprisingly, it has been found that this problem no longer occurs with the construction according to the invention.

Figure 1:
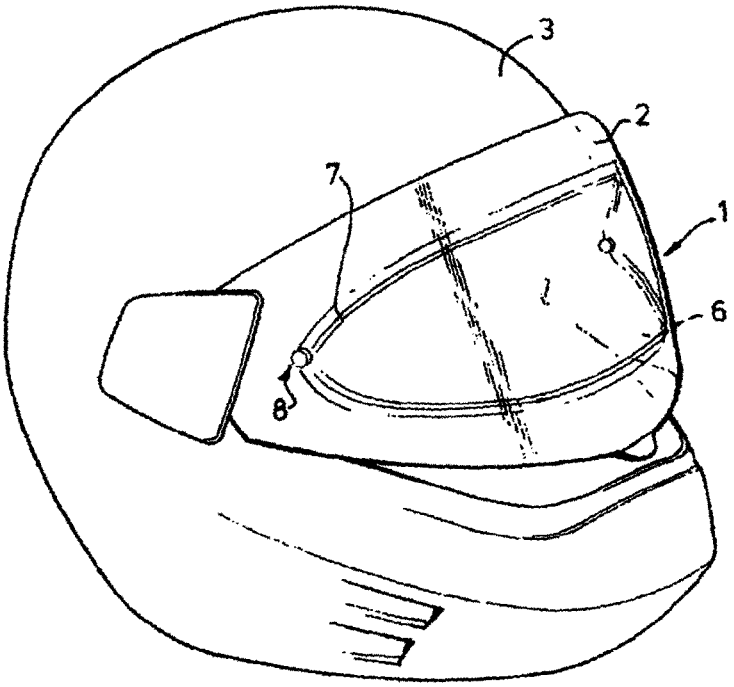
FIG. 1 shows a helmet provided with an embodiment of a visor assembly according to the invention.
Figure 2:
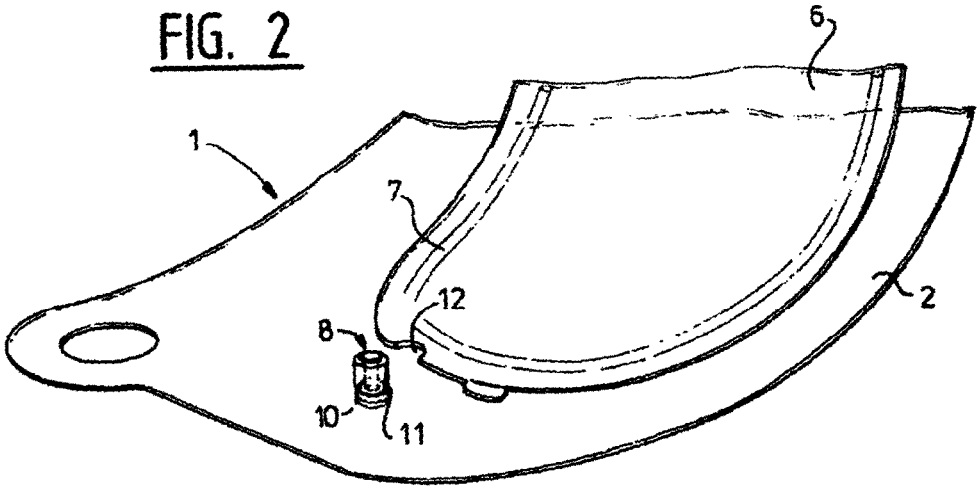
FIG. 2 is a perspective view of a detail of the visor assembly of FIG. 1.

In FIG. 1 the visor assembly according to the invention is designated as a whole with reference numeral 1. Shown is an outer visor which is connected hingedly to a helmet 3 in a manner not further shown. As further shown in FIG. 2, visor assembly 1 also comprises an inner shield 6 in addition to outer shield 2. The outer shield can be manufactured from polycarbonate or from other transparent plastics. Inner shield 6 comprises recesses 12 which are compatible with pins 10 arranged in outer shield 2. Pins 10 and recesses 12 together form retaining means 8 for holding the inner shield against an inner side of outer shield 2. Such a construction is described more particularly in the European application 95937212.9, which is incorporated into this description by reference. Any other mechanical fixing constructions known in the prior art can be applied instead of the shown fixing means 8.

When inner shield 6 and outer shield 2 are connected, a complete sealing takes place between inner shield 6 and outer shield 2. This sealing is elucidated in further detail hereinbelow. Inner shield 6 and outer shield 2 can be removed from each other in simple manner as a result of the fixing means. It will be apparent here that the properties of inner shield 6 are such that no appreciable adhesive force occurs between inner shield 6 and outer shield 2 when they are mounted relative to each other.

Figure 3:
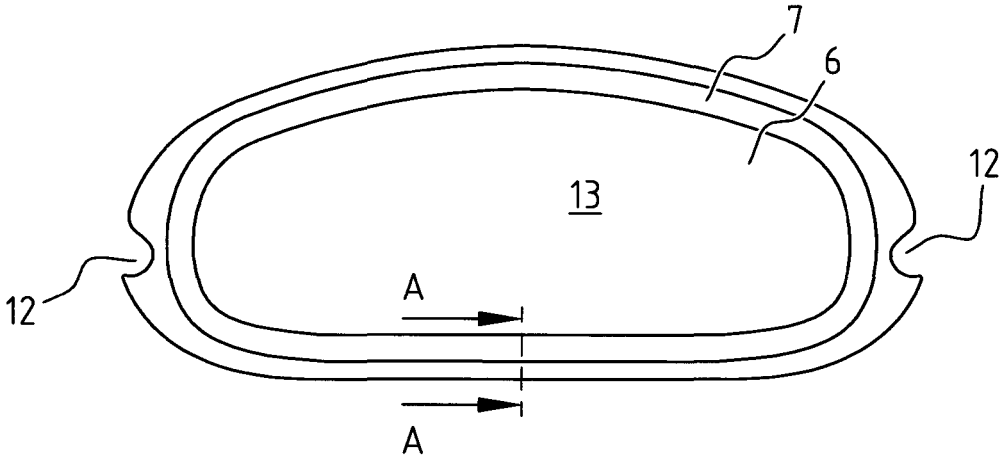
FIG. 3 is a plane view of an inner shield according to an embodiment of the invention.

Inner shield 6 is shown in FIG. 3 and comprises a spacer 7 extending along the periphery of the inner shield. Spacer 7 is preferably continuous and spacer 7 encloses a central zone 13 of inner shield 6. Spacer 7 hereby lies all around central zone 13. When inner shield 6 is mounted against outer shield 2, spacer 7 will be pressed against outer shield 2. The inner shield, more particularly central zone 13 of inner shield 6, is hereby held a predetermined distance from the outer shield. This predetermined distance can be constant or can be variable along the length (or other dimension) of the inner shield. In such a mounted situation inner shield 2 extends substantially parallel to and with substantially the same shape as the outer shield, at least at the position of central zone 13. With the same shape relates here to the curvature of the surface of the outer shield.

In some visors the distance between inner shield and outer shield will have to be minimal in the centre of the visor in order to minimize the overall thickness at this position. If the visor is too thick (or not minimal) here, the inner shield may scrape against the helmet when the visor is folded open and/or shut. It is therefore advisable in a preferred embodiment of the invention to provide the outer ends of the inner shield (at the position of fixing means 12) with a deeper protrusion, wherein the depth of the protrusion decreases in the direction of a central zone of the inner shield. The inner shield will hereby become slightly stiffer as a whole, and there is less chance of the inner shield coming to he against the visor due to weakening. If the inner shield comes to lie against the outer shield so-called Newton's rings occur, whereby visibility is drastically reduced.

Figure 4A:
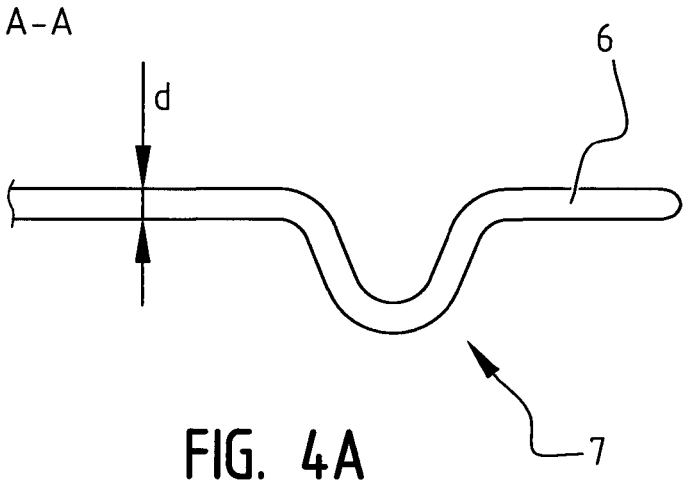
FIG. 4 shows a cross-section of the protrusion from the inner shield of FIG. 3.

Spacer 7 is formed as a protrusion from inner shield 6. The thickness d of inner shield 6 is preferably constant here. FIG. 4A shows an embodiment of a cross-section of inner shield 6 at the position of protrusion 7. FIG. 4A particularly shows cross-section A-A of the inner shield of FIG. 3. Because the protrusion is formed along the periphery, the protrusion has a direction (which runs along the periphery). Because the protrusion has a direction, the protrusion can be intersected transversely (at a right angle to the direction).

FIG. 4A shows how protrusion 7 is U-shaped. Another possible description of the shape is channel-like. A preferred feature of this shape is that inner shield 6 lies in the same plane at the position of central zone 13 and at the position of a peripheral edge. The material of the inner shield hereby moves out of the plane at the position of the protrusion. Such a protrusion 7 is preferably obtained by deforming an inner shield 6 of flat form, for instance in a mould. When such a shape 7 is applied, the depth of the channel is preferably substantially constant along the length of the channel. Substantially constant is defined here as being without sudden changes along the length of the channel, i.e. having a continuous depth profile along the length of the channel. The width of the channel is optionally also constant along the length of the channel. A space is hereby delimited by the channel between inner shield and outer shield when inner shield lies against outer shield, which space is sealed airtightly from the surroundings. Air which insulates the outer shield and inner shield relative to each other is typically confined in this space. Inner shield and outer shield can hereby have different temperatures. In the case a helmet is for instance used on a snow scooter the outer shield will be cold due to cold ambient air, while the inner shield will be roughly body temperature. The same effect is obtained in other applications of visors, such as in work safety helmets, police helmets, fire helmets and also in diving goggles. Because inner shield is insulated from outer shield, the two shields can function optimally. The inner shield of the invention is preferably manufactured from cellulose acetate material which is heat-treated or has had an anti-fogging treatment. Use of such a material has the advantage that the inner shield then does not mist up, and that the inner shield is still sufficiently bendable to lie parallel to the surface of the outer shield (which is typically curved).

Figure 4B:
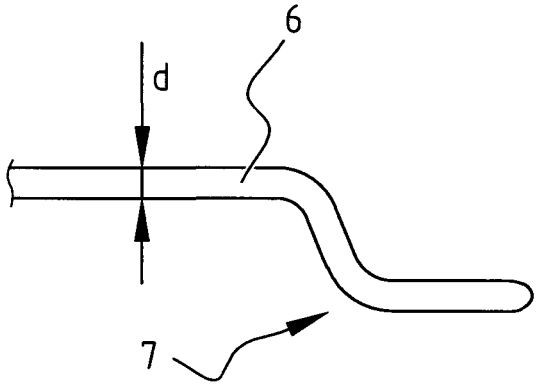

FIG. 4B shows an alternative embodiment of a protrusion 7. The protrusion here has a sigmoid-shaped cross-section. The edge of the inner shield will hereby extend in a plane lying at a distance from the plane of central zone 13 of the inner shield. Such a deformation is also deemed a protrusion. Protrusion is defined as movement out of the plane of the inner shield at a limited location. As shown in FIG. 4A, this protrusion 7 can be formed at a distance from the edge or, as shown in FIG. 4B, at the position of the edge.

The manufacture of such an inner shield 6 with protrusion is quick and easy. Using a sheet material, inner shield 6 can be cut into the desired shape and be deformed in one processing step in order to obtain the protrusion along the periphery of inner shield 6. This processing step can be performed in a mould having cutting edges for cutting out the periphery of inner shield 6 and having deforming surfaces for creating the protrusion in the sheet-like material. The skilled person will be familiar with moulds with cutting edges and deforming surfaces. This mould is therefore not discussed in further detail.

An alternative embodiment of the invention is that inner shield 6 with a protrusion is manufactured by injection moulding. When inner shield 6 is manufactured by injection moulding it is possible to deviate from a constant thickness d of inner shield 6, and the protrusion can be arranged as thickened portion on the inner shield and be formed integrally with the rest of the inner shield (from the same material).

The above described embodiments and the figures are purely illustrative and serve only to increase the understanding of the invention. The invention will therefore not be limited to the embodiments described here, but is defined in the claims.

The invention claimed is:

1. Visor assembly comprising: an outer shield, and an inner shield which is arranged at a distance therefrom and lies within the periphery of the outer shield, wherein a spacer extending along the periphery of the inner shield is provided in order to hold the inner shield at a predetermined distance from the outer shield, wherein mechanical fixing means are arranged between the two shields for mutual fixation thereof, wherein the inner shield is formed at the position of its periphery such that a protrusion from the inner shield is obtained, the protrusion forming the spacer, and wherein the protrusion is arranged in the inner shield by mechanical deformation of the inner shield.

2. Visor assembly as claimed in claim 1, wherein the inner shield has a substantially constant thickness.

3. Visor assembly as claimed in claim 1, wherein the protrusion has a U-shaped cross-section.

4. Visor assembly as claimed in claim 1, wherein the protrusion is formed as a continuous channel running around a central zone of the inner shield, this continuous channel having a substantially constant depth.

5. Visor assembly as claimed in claim 4, wherein the continuous channel further has a substantially constant width.

6. Visor assembly as claimed in claim 1, wherein the mechanical fixing means comprise pins arranged on the outer shield and co-acting with recesses arranged on the inner shield.

7. Visor assembly as claimed in claim 1, wherein the outer shield comprises polycarbonate.

8. Visor assembly as claimed in claim 1, wherein the inner shield comprises cellulose acetate material which is heat-treated or has had an anti-fogging treatment.

9. Inner shield of a visor assembly as claimed in claim 1, wherein the inner shield is provided so as to be placed within the periphery of an outer shield and at a distance therefrom, wherein a spacer extending along the periphery of the inner shield is provided in order to hold the inner shield at the predetermined distance, wherein the inner shield is provided with mechanical fixing means for fixing the inner shield relative to the outer shield, and wherein the inner shield is deformed at the position of its periphery such that a protrusion from the inner shield is obtained, the protrusion forming the spacer.

10. Method for manufacturing an inner shield as claimed in claim 9, comprising creating a protrusion along the periphery of the inner shield by means of deformation.

11. Method as claimed in claim 10, further comprising cutting the inner shield from a sheet-like material such that the inner shield fits within the periphery of a predetermined outer shield.

12. Method as claimed in claim 11, wherein the step of creating the protrusion and the step of cutting are performed simultaneously in a mould which comprises corresponding deforming surfaces and cutting edges for this purpose.

* * * * *